US007984600B2

(12) United States Patent
Alford et al.

(10) Patent No.: US 7,984,600 B2
(45) Date of Patent: Jul. 26, 2011

(54) GROUTLESS TILE SYSTEM AND METHOD FOR MAKING THE SAME

(75) Inventors: Tom Alford, Rockwall, TX (US); Mark Cappelle, Staten (BE)

(73) Assignee: Mohawk Carpet Corporation, Calhoun, GA (US)

( * ) Notice: Subject to any disclaimer, the term of this patent is extended or adjusted under 35 U.S.C. 154(b) by 165 days.

(21) Appl. No.: 11/701,777

(22) Filed: Feb. 2, 2007

(65) Prior Publication Data

US 2008/0184646 A1 Aug. 7, 2008

(51) Int. Cl.
*E04B 2/00* (2006.01)

(52) U.S. Cl. ..... 52/588.1; 52/589.1; 52/385

(58) Field of Classification Search ..... 52/578, 52/592.1, 588.1, 589.1, 384–392
See application file for complete search history.

(56) References Cited

U.S. PATENT DOCUMENTS

| | | | | |
|---|---|---|---|---|
| 2,030,556 | A * | 2/1936 | Veltung | 52/318 |
| 2,693,102 | A | 11/1954 | Luster et al. | |
| 2,852,932 | A * | 9/1958 | Cable | 52/385 |
| 3,239,981 | A * | 3/1966 | Fitzgerald | 428/44 |
| 3,594,969 | A * | 7/1971 | Kantorowicz | 52/392 |
| 4,028,159 | A | 6/1977 | Norris | |
| 4,519,114 | A | 5/1985 | Rhyne | |
| 5,323,575 | A * | 6/1994 | Yeh | 52/177 |
| 5,362,560 | A * | 11/1994 | Ehrhart et al. | 428/343 |
| 5,437,934 | A * | 8/1995 | Witt et al. | 428/537.1 |
| 5,535,945 | A | 7/1996 | Sferrazza et al. | |
| 5,598,980 | A | 2/1997 | Dilly-Louis et al. | |
| 5,722,603 | A | 3/1998 | Costello et al. | |
| 6,006,486 | A | 12/1999 | Moriau et al. | |
| 6,029,916 | A | 2/2000 | White | |
| 6,059,207 | A | 5/2000 | Costello et al. | |
| 6,189,289 | B1 * | 2/2001 | Quaglia et al. | 52/764 |
| 6,250,575 | B1 | 6/2001 | White | |
| 6,343,451 | B1 | 2/2002 | Chih et al. | |
| 6,385,936 | B1 * | 5/2002 | Schneider | 52/589.1 |
| 6,467,224 | B1 | 10/2002 | Bertolini | |
| 6,543,196 | B1 * | 4/2003 | Gonzales | 52/386 |
| 6,647,690 | B1 | 11/2003 | Martensson | |

(Continued)

FOREIGN PATENT DOCUMENTS

BE 1014439 10/2003

(Continued)

OTHER PUBLICATIONS

International Search Report for related PCT Application No. PCT/IB 02/05754 dated Mar. 4, 2003.

(Continued)

*Primary Examiner* — Eileen Lillis
*Assistant Examiner* — Theodore Adamos
(74) *Attorney, Agent, or Firm* — Ryan A. Schneider, Esq.; Dean Y. Shahriari; Troutman Sanders LLP

(57) ABSTRACT

A groutless tile system including: a plurality of groutless tiles, wherein each groutless tile includes: a durable surface disposed on a substrate; and a first coupling member disposed on an edge of the substrate; wherein at least a portion of the substrate extends beyond the durable surface, wherein the first coupling member and a second coupling member of an adjacent tile are operable for coupling adjacent groutless tiles, and wherein the substrate prevents the durable surfaces of adjacent groutless tiles from contacting one another.

12 Claims, 3 Drawing Sheets

U.S. PATENT DOCUMENTS

| | | | | |
|---|---|---|---|---|
| 6,694,689 | B1 * | 2/2004 | Scott et al. | 52/392 |
| 6,752,336 | B1 | 6/2004 | Wingard | |
| 6,769,218 | B2 * | 8/2004 | Pervan | 52/591.4 |
| 6,769,835 | B2 | 8/2004 | Stridsman | |
| 6,786,988 | B1 | 9/2004 | Bell | |
| 6,814,826 | B1 | 11/2004 | Bell | |
| 6,814,862 | B2 | 11/2004 | Biesel | |
| 6,854,235 | B2 | 2/2005 | Martensson | |
| 6,883,667 | B1 | 4/2005 | Lindsey et al. | |
| 6,883,668 | B1 | 4/2005 | Lindsey et al. | |
| 6,925,764 | B2 * | 8/2005 | Hrovath et al. | 52/390 |
| 6,953,119 | B1 | 10/2005 | Wening | |
| 6,990,777 | B2 * | 1/2006 | Poliacek et al. | 52/384 |
| 7,040,068 | B2 * | 5/2006 | Moriau et al. | 52/591.3 |
| 7,045,590 | B2 | 5/2006 | Bell | |
| 7,171,791 | B2 * | 2/2007 | Pervan | 52/592.1 |
| 7,197,855 | B2 * | 4/2007 | Della Pepa | 52/460 |
| 7,243,469 | B2 * | 7/2007 | Miller et al. | 52/311.1 |
| 2002/0189183 | A1 * | 12/2002 | Ricciardelli | 52/390 |
| 2004/0031225 | A1 * | 2/2004 | Fowler | 52/578 |
| 2004/0031226 | A1 * | 2/2004 | Miller et al. | 52/588.1 |
| 2004/0139676 | A1 | 7/2004 | Knauseder | |
| 2004/0139679 | A1 * | 7/2004 | Della Pepa | 52/578 |
| 2004/0211143 | A1 | 10/2004 | Hanning | |
| 2004/0213946 | A1 * | 10/2004 | Miller | 428/57 |
| 2004/0226241 | A1 * | 11/2004 | Forster et al. | 52/384 |
| 2005/0055943 | A1 * | 3/2005 | Pervan | 52/578 |
| 2005/0079323 | A1 * | 4/2005 | Miller et al. | 428/141 |
| 2005/0144875 | A1 | 7/2005 | Lenhard-Backhaus et al. | |
| 2006/0080910 | A1 * | 4/2006 | Cornia | 52/177 |
| 2006/0260254 | A1 * | 11/2006 | Pervan | 52/592.1 |
| 2007/0022694 | A1 * | 2/2007 | Chen et al. | 52/578 |
| 2007/0039267 | A1 * | 2/2007 | Swanson | 52/391 |
| 2007/0220822 | A1 * | 9/2007 | Permesang | 52/392 |

FOREIGN PATENT DOCUMENTS

| | | | |
|---|---|---|---|
| CN | 1812873 | | 8/2006 |
| DE | 1659465 | | 3/1971 |
| DE | 2533733 | | 2/1976 |
| DE | 8801796 | | 6/1988 |
| DE | 3932951 | | 4/1991 |
| DE | 4018377 | | 12/1991 |
| DE | 9310954.7 | U1 | 9/1993 |
| DE | 4435571 | | 4/1996 |
| DE | 19606027 | | 8/1997 |
| DE | 19823357 | | 11/1999 |
| DE | 19944399 | A1 | 4/2001 |
| DE | 19962812 | | 6/2001 |
| DE | 10004763 | | 12/2001 |
| DE | 10027039 | | 12/2001 |
| DE | 20114787 | | 1/2002 |
| DE | 10344755 | | 4/2005 |
| DE | 10355370 | | 6/2005 |
| EP | 0246856 | | 11/1977 |
| EP | 0044371 | | 1/1982 |
| EP | 0145675 | | 6/1985 |
| EP | 0544604 | | 6/1993 |
| EP | 0742326 | | 11/1996 |
| EP | 0911462 | | 4/1999 |
| EP | 1106587 | A2 | 6/2001 |
| EP | 1264945 | | 12/2002 |
| EP | 1306485 | | 5/2003 |
| EP | 1329568 | | 7/2003 |
| EP | 1441086 | | 7/2004 |
| FR | 2073519 | | 9/1971 |
| FR | 2461073 | | 1/1981 |
| FR | 2487407 | * | 1/1982 |
| WO | WO 03/036000 | | 5/2003 |
| WO | WO 2004/018798 | | 3/2004 |
| WO | WO 2004/097141 | | 11/2004 |
| WO | WO 2005/040522 | | 5/2005 |
| WO | WO 2005/052279 | | 6/2005 |
| WO | WO 2006/045197 | | 5/2006 |

OTHER PUBLICATIONS

International Search Report for related PCT Application No. PCT/NL2004/000735 dated Jan. 24, 2005.

International Search Report for related PCT Application No. PCT/EP2004/053107 dated Mar. 24, 2005.

Partial International Search Report for PCT Application No. PCT/US2008/052833 dated Aug. 7, 2008.

International Search Report of PCT/US2008/052833.

Written Opinion of the International Searching Authority for PCT/US2008/052838.

First Office Action dated Sep. 14, 2010 issued by The State Intellectual Property Office of the People's Republic of China for related Chinese Application No. 200880003927.3.

Official Action dated Dec. 27, 2010 for related European Application No. 08728856.9.

* cited by examiner

GROUTLESS TILE SYSTEM AND METHOD FOR MAKING THE SAME

BACKGROUND OF THE INVENTION

1. Field of the Invention

The present invention relates generally to floor and wall covering tiles. More particularly, it relates to a tile system that does not require a grout compound to be applied to the tiles after installation.

2. Description of Related Art

Ceramic tiles are widely used as a floor and wall covering in both residential and commercial applications. Tile is very versatile, and has been in use as a floor and wall covering for centuries. Tiles are available in a nearly unlimited color palette and may be installed in an equally unlimited number of designs. Tile is often a top choice for floor and wall coverings because of its great durability and aesthetic qualities. While many tiles are manufactured from ceramic compositions (baked clay), they may be made of a variety of natural or synthetic materials including, but not limited to, granite, quartz, marble, soapstone, plastic, wood, or a other suitable material.

Tile provides a durable surface and may be coated to be substantially impervious to water and other liquids. When tiles are installed, they are generally laid side by side on a surface such as a floor or wall. Typically, an adhesive compound is used as a base to attach the tiles to a surface and then grout is spread over and between the tiles to further bind the tiles to the surface and to fill spaces between adjacent tiles. While not impervious to water and moisture, the grout provides a barrier to reduce moisture between and behind the tiles. This step of grouting the tiles is labor intensive and represents a significant portion of the labor involved in a typical tile installation.

Due to the time and labor involved in tile installation, it is typically quite costly to have tile professionally installed. Accordingly, many homeowners desire to install tile in their own homes. Unfortunately, this is an extremely tedious process, and many homeowners do not wish to spend the time necessary for a satisfactory installation.

In recent years, manufacturers have attempted to produce do-it-yourself tile solutions that are easier to install. One such attempt is described in United States Publication Number US 2004/0031226 entitled "Pre-glued Tongue and Groove Flooring" by Miller et al. Disclosed therein is a laminated "tile" that uses a pre-applied glue for fastening the tiles together. While this system is easier to install than traditional tiles, it still requires a separate grout to be applied and uses a laminate material rather than a solid tile. A laminate material is not likely to be as durable as more traditional materials such as ceramic or stone tiles. Additionally, because the this tile system makes use of a laminated structure that is susceptible to moisture damage, the installer is required to apply a messy grout composition to the tiles as part of the installation process.

A previous attempt to produce an easy to install tile is described in U.S. Pat. No. 2,693,102 entitled "Interlocking Wall Tile." The '102 patent describes a synthetic wall tile system that snaps together. Unfortunately, this tile is not practicable with substantially ridged materials, such as ceramic, granite, or marble. The Luster et al. tiles are molded into a uniform structure of a single material and rigid materials could not be formed into an operable tab structure as taught in the patent. Such a limitation severely limits the aesthetic qualities available for the tiles and thereby reduces the marketability of the system.

Accordingly, there is a need in the art for a tile system that is simple to install.

Additionally, there is a need in the art for a tile system that does not require a grout to be applied to the tiles after installation.

Further, there is a need in the art for an easy to install tile system that makes use of durable tile materials.

In addition, there is a need in the art for a tile system that primarily utilizes traditional tile materials, but eliminates the need for grout.

BRIEF SUMMARY OF THE INVENTION

Briefly, described herein is a tile having at least one coupling member that cooperatively engages a coupling member of an adjacent tile, such that adjacent tiles can be reasonably secured to one another without the use of grout. In one exemplary embodiment, cooperative coupling members are a male-type coupling members and female-type coupling members that are designed to secure adjacent tiles.

In exemplary embodiments, a wide variety of tiling systems may be used. For example, in one exemplary tiling system individual tiles may include all male-type or all female-type coupling members. In another example, the individual tiles may include two male-type coupling members and two female-type coupling members located on either adjacent or opposing edges of the tiles. In yet another example, the individual tiles may have another combination of male-type and female-type coupling members disposed on one or more of the edges of the tiles. The above examples are only intended as illustrations and are not intended to be limiting in any way; on the contrary, a wide variety of alternative exemplary embodiments would be understood to a person of ordinary skill in the art.

Disclosed herein is a groutless tile system including: a plurality of groutless tiles, wherein each groutless tile includes: a durable surface disposed on a substrate; a first coupling member disposed on an edge of the substrate; and a second coupling member disposed on an opposing edge of the substrate, wherein at least a portion of the substrate extends beyond the durable surface, wherein the first coupling member and the second coupling member of the groutless tiles are operable for coupling adjacent groutless tiles, and wherein the substrate maintains spacing between the durable surfaces of adjacent groutless tiles.

Also disclosed herein is a groutless tile including: a durable surface disposed on a substrate; a first coupling member disposed on an edge of the substrate; and a second coupling member disposed on an opposing edge of the substrate, wherein the first coupling member and the second coupling member of the substrate extend beyond the durable surface, wherein the first coupling member and the second coupling member of the groutless tile are operable for coupling the groutless tile to an adjacent groutless tile, and wherein at least a portion of the substrate extends vertically to form a substantially continuous surface with the durable surface.

Further disclosed herein is a method for making a groutless tile including: providing a durable surface; molding a substrate to receive at least a portion of the durable surface; affixing the durable surface to the substrate; and milling at least a portion of the substrate to create a first coupling member on an edge of the substrate and a second coupling member on a opposing edge of the substrate.

Still further disclosed herein is a floor covering consisting of floor elements including at least a synthetic support structure and a decorative element selected form the group consisting of natural stone, terracotta, ceramic tile and synthetic stone; the decorative element being supported, either directly or indirectly, by the support structure and at least partially defining the upper side of the floor element; the support structure at least at a first pair of two opposite sides including coupling parts, which are realized substantially as a male coupling part and a female coupling part, which are provided with vertically active locking portions, which, when the coupling parts of two of such floor elements cooperate with each other, effect a locking in a vertical direction and also are provided with horizontally active locking portions, which, when the coupling parts of two of such floor elements cooperate with each other, effect a locking in horizontal direction whereby the coupling parts are of the type allowing that two of such floor elements can be connected to each other at the sides by engaging one of these floor elements with the associated male coupling part, by means of a rotational and/or planer motion, in the female coupling part of the other floor element; wherein the male coupling part projects at least partially beyond the upper edge of the concerned side. In a preferred embodiment said horizontally active locking portion, in a coupled condition of two such floor elements or tiles, is located vertically under a durable surface of at least one of said tiles. Said durable surface is preferably formed by said decorative element. In another or the same preferred embodiment said vertically active locking portions can substantially have the shape of a tongue and a groove, which in a coupled condition of two of such floor elements or tiles, preferably, wholly or partially, engage vertically under a portion of the synthetic support structure or substrate, whereby this portion of the substrate extends horizontally beyond said durable surface or said decorative element of at least one of said tiles. It is possible that contact surfaces are formed between the tongue and the groove, said contact surfaces preventing or limiting vertical motion of two tiles or floor elements in a coupled condition thereof. At least one of said contact surfaces, being located at the top side of the tongue, is preferably located in a plane, e.g. a horizontal plane, which intersects the decorative element forming said durable surface. Instead of being located in a plane, the concerned contact surface might also show a point of contact which is located the closest to the durable surface and which is located in a horizontal plane which intersects the decorative element forming said durable surface.

Also disclosed herein is a method for manufacturing floor elements including at least a synthetic support structure and a decorative element selected from the group consisting of natural stone, terracotta, ceramic tile and synthetic stone; the decorative element being supported, either directly or indirectly, by the support structure and at least partially defining the upper side of the floor element; the support structure having edge portions; the edge portions at least at two opposite sides of the support structure having coupling parts; wherein the method at least includes the following two successive steps: the step of providing a semi-finished product including at least the aforementioned support structure and the aforementioned decorative element; the step of performing a machining treatment on at least an edge portion of the already formed semi-finished product, more particularly on the edge portions of the support structure of the semi-finished product, in order to manufacture at least part of the coupling parts to be formed therein.

These and other objects, features and advantages of the present invention will become more apparent upon reading the following specification in conjunction with the accompanying drawing figures.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

As used herein, the term "disposed" generally means located either at or upon. Additionally, the term disposed is intended to include an element integrally or detachableably connected to another element as well as object simple placed on another element. Furthermore, it will be understood that when an element is referred to as being "disposed on" another element, it can be directly on the other element or intervening elements may be present there between. In contrast, when an element is referred to as being "disposed directly on" another element, there are no intervening elements present.

Figure 1:
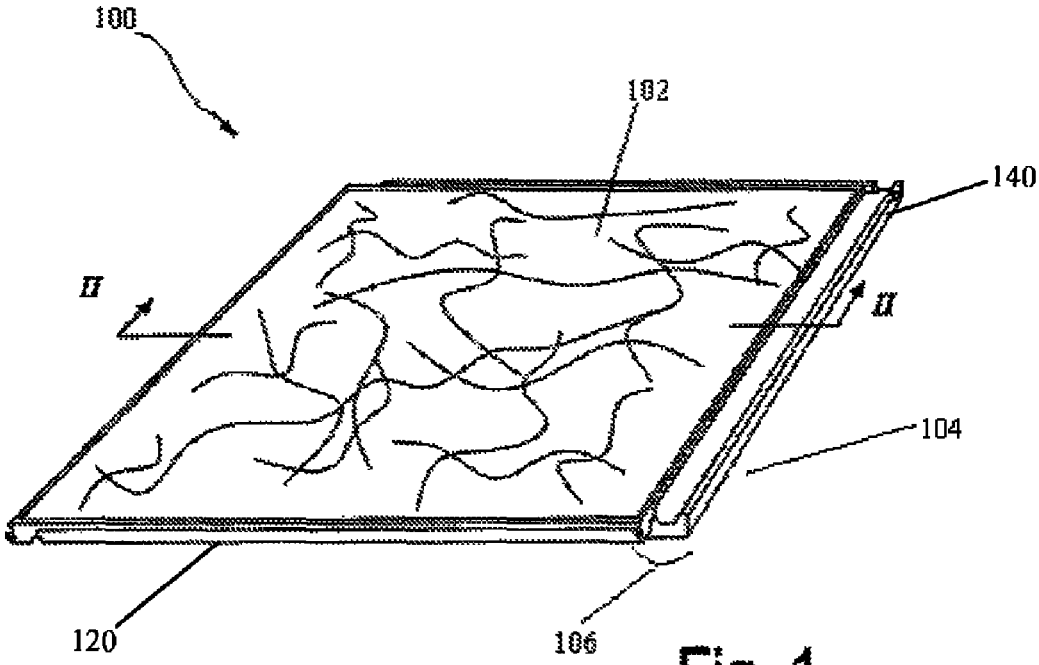
FIG. 1 is a perspective view illustration of a tile in accordance with an exemplary embodiment of the present invention.

Referring now to FIG. 1, a groutless tile in accordance with an exemplary embodiment of the present invention is generally depicted as 100. The groutless tile 100 includes a durable surface 102 that is disposed on a substrate 104. In exemplary embodiments, the durable surface 102 may be affixed to the substrate 104 using a wide variety of methods such as the use of an adhesive. The durable surface 102 may be a ceramic composition (baked clay), or it may be made of a variety of natural or synthetic materials including, but not limited to, granite, quartz, marble, soapstone, plastic, wood, or another suitable material. Likewise, the substrate 104 may be a made of a suitable polymeric material. In exemplary embodiments, the substrate 104 may be constructed of a suitable material that is chemical resistant, stain resistant, non-porous, and formable to within sufficient precision. While the groutless tile 100 is depicted in a square shape, it will be clear that alternate shape groutless tiles such as hexagon, octagon, or the like are also contemplated.

In exemplary embodiments, the substrate 104 is designed to have larger dimensions than the durable surface 102 such that the durable surface 102 may be disposed within a groove defined by the substrate 104. In one embodiment, the top surface of the durable surface 102 and the top surface of the substrate 104 may form a continuous surface. The substrate 104 includes a flange portion 106 that is disposed along the edges of the substrate 104. The flange portion 106 further includes a first coupling member 120 and a second coupling member 140, which may be disposed on opposing or adjacent sides of the groutless tile 100. The first coupling member 120 and the second coupling member 140 are designed such that they are operable for coupling together one or more adjacent groutless tiles 100.

In exemplary embodiments, the groutless tile 100 may include an underlayment layer that may act as a moisture or sound barrier. Additionally, the underlayment may serve a surface leveling function. Further, the underlayment may serve as an adhesive for attaching the tiles to an installation surface, such as a floor or a wall. The composition of the underlayment layer may depend upon the intended purpose of the underlayment layer. In exemplary embodiments, the underlayment layer may be a multilayered layment composed of several distinct layers each designed to perform a specific function. The underlayment may be secured to substrate 104 of the groutless tile 100 through the use of an adhesive or another suitable means.

In an exemplary embodiment, at least a portion of the flange portion 106, may be of polymeric material and preferably is a polyurethane material, such as ELASTOCASTr70654 by BASF®. ELASTOCASTr70654 is an unpigmented, 77 to 79 Shore D urethane elastomer designed for cross-sections up to three inches, which has some inherent tackiness. It is also contemplated that another polymeric material may be used in flange portion 106. The following data may be helpful in producing the material used in a flange portion 106 in accordance with an exemplary embodiment. This data is provided for example only, and is not intended to limit the scope of the invention. Other compositions may also be used to fabricate the flange portion 106.

| | | |
|---|---|---|
| Mix Ratio @ 105 index: | 100 parts of ELASTOCASTr7065R Resin<br>771. parts of WUC 3192T ISOCYANATE | |
| Specific Gravity: | Resin 1/048 f/cc, 8.72 lbs./gal. @ 77° F.<br>Iso 1.22 g/cc, 10.2 lbs./gal. @ 77° F. | |
| Viscosity: | Resin 1220 cps @ 77° F.<br>Iso 200 cps @ 77° F. | |
| Typical Reactivity: | Hand mixed at 86° F. at 105 index<br>Gel time: 180 to 240 seconds | |
| Recommended processing conditions: | Component temperatures: | Resin 75-95° F.<br>Iso 75-95° F. |
| | Mold temperature: | 130-160° F. |
| | Demold time: | 10-20 minutes |

Alternatively, other polymer variations, such as polyamides, vinyl polymers and polyoletins may be used. Preferably, the flange portion 106 may be made, but is not so limited, from a material that is chemical resistant, stain resistant, non-porous, and formable to within sufficient precision. Additionally, it may be desirable for the flange portion 106 to have sealing qualities so as to impede the intrusion of moisture between and behind the tiles and adherence qualities so as to minimize or present movement or displacement of the tiles.

Figure 2:
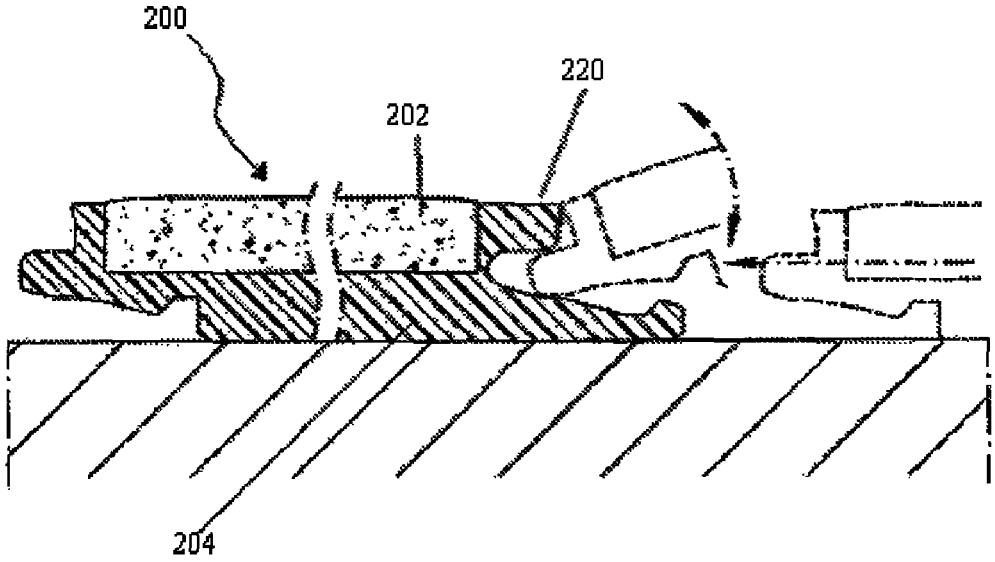
FIG. 2 is a cross-sectional view illustration of another tile in accordance with an exemplary embodiment of the present invention.
Figure 3:
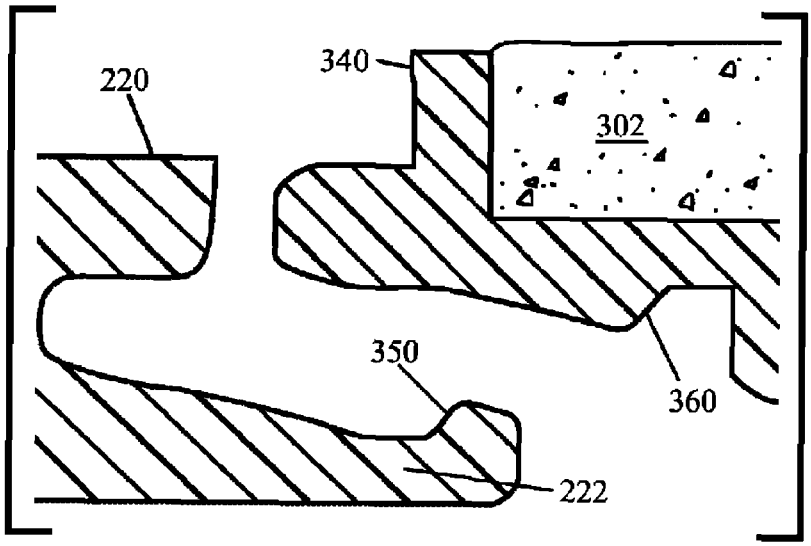
FIG. 3 is a cross-sectional view illustration of two adjacent tiles in accordance with an exemplary embodiment of the present invention.
Figure 3:
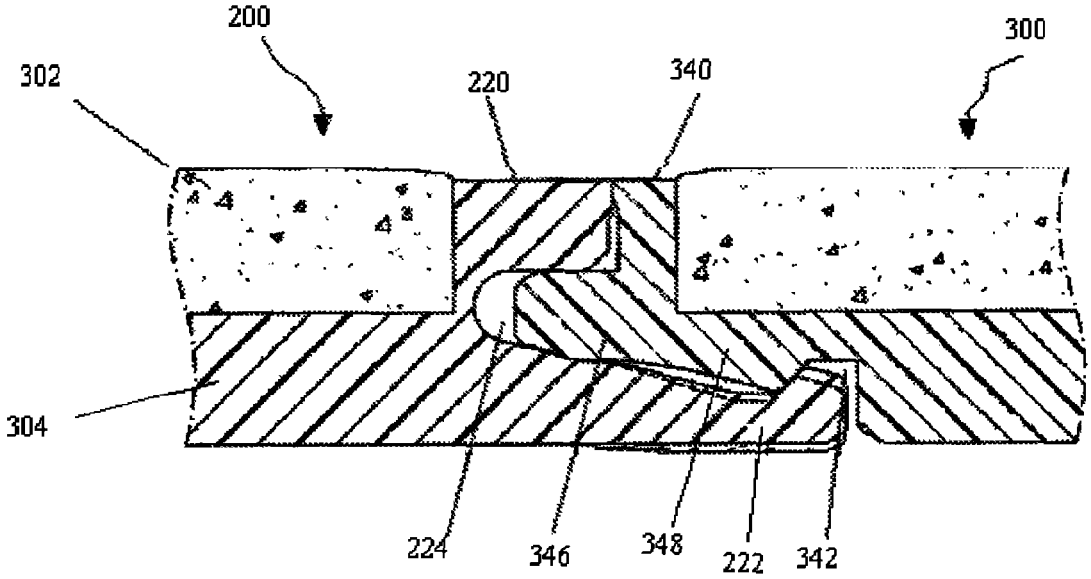

Turning now to FIGS. 2-3 which illustrate the coupling of a first groutless tile 200 with a second groutless tile 300. A first coupling member 220 and a second coupling member 340 function to connect the first groutless tile 200 and the second groutless tile 300. The first coupling member 220 of the first groutless tile 200 includes a first bendable portion 222 and a groove 224. The second coupling member 340 of the second groutless tile 300 includes a tongue 346 and a body portion 348. The groove 224 of the first coupling member 220 is designed to receive the body portion 348 and the tongue 346 of the second coupling member 340. Once positioned inside the groove 224 of the first coupling member 220 the body portion 348 and the tongue 346 contacts the first bendable portion 222 and the groove 224, respectively. In one embodiment, the tongue 346 and the first bendable portion 222 are designed to bend at least the first bendable portion during the coupling of the groutless tile 200 and the second groutless tile 300. Additionally, the tongue 346 and the first bendable portion 222 are designed such that at least the first bendable portion 222 returns to or towards its normal unbent position once the groutless tile 200 and the second groutless tile 300 are coupled in order to prevent the tiles from separating. A contact surface between said tongue 346 and said groove 224 is also formed at the top side of said tongue 346, whereby said contact surface is located in a horizontal plane, which intersects the decorative element forming said durable surface 102.

Continuing with reference to FIG. 3, the first bendable portion 222 includes an enlarged portion on its distal end that has an inclined inner surface 350. Additionally, the body portion 348 of the second coupling member 340 also includes an inclined surface 360 on its proximal end. The inclined inner surface of the first bendable portion 222 is designed to have a substantially complimentary angle to that body portion 348 of the second coupling member 340. The first bendable portion 222 is designed to slideably contact the body portion 348 during the coupling of the groutless tile 200 and the second groutless tile 300. Furthermore, the inclined surfaces of the first bendable portion 222 and body portion 348 are operable for properly positioning and the groutless tile 200 and the second groutless tile 300 during coupling. In exemplary embodiments, the inclined surfaces of the first bendable portion 222 and the body portion 348 function to keep the groutless tile 200 and the second groutless tile 300 properly positioned while the tiles are coupled to one another. Said inclined inner surfaces of both said body portion 348 and said enlarged portion 342 form horizontally active locking portions, which in a coupled condition are located vertically under a durable surface 202, 302 of at least one of said tiles 200-300.

In exemplary embodiments, the tongue 346 is located at the distal end of the second coupling member 340 and extends substantially horizontally and outwardly from the second groutless tile 300. Said tongue 346 of said second coupling member 340 and said groove 224 of the first coupling member 220 are vertically active locking portions and wholly engage vertically under a portion of the synthetic support structure or substrate 204, 304, whereby this portion of the substrate 104 extends horizontally beyond said durable surface 202, 302 or said decorative element of at least one of said tiles 200-300.

In exemplary embodiments, the first groutless tile 200 may be coupled to the second groutless tile 300 by snapping or pushing the second coupling member 340 of the second groutless tile 300 into the first coupling member 220. In one embodiment, a lateral or horizontal is necessary to properly couple the first groutless tile 200 and the second groutless tile 300. Furthermore, during the coupling of the groutless tile 200 and the second groutless tile 300 the second coupling member 340 of the second groutless tile 300 may be locked into position once inserted into the groove 224 of the first coupling member 220. Additionally, during the coupling of the first groutless tile 200 and the second groutless tile 300 the first bendable portion 222 may be bent to accommodate the insertion of the first body portion 348 into the groove 224. After the first groutless tile 200 and the second groutless tile 300 are coupled the first bendable portion 222 returns to or towards its normal unbent position and remains in contact with the body portion 348. In exemplary embodiments, the first groutless tile 200 and the second groutless tile 300 may be separated from one another by pivotally disengaging the first groutless tile 200 from the second groutless tile 300, preferably without damaging the respective tiles and their coupling members. It is noted that in a completely coupled condition of the respective groutless tiles 200-300, it is possible that the first bendable portion 222 is bent out of the level under surface of said tiles 200-300. Such bending out might create an extra firm coupling especially in the horizontal direction, thereby strongly preventing separation of two coupled tiles in said horizontal direction.

Figure 4:
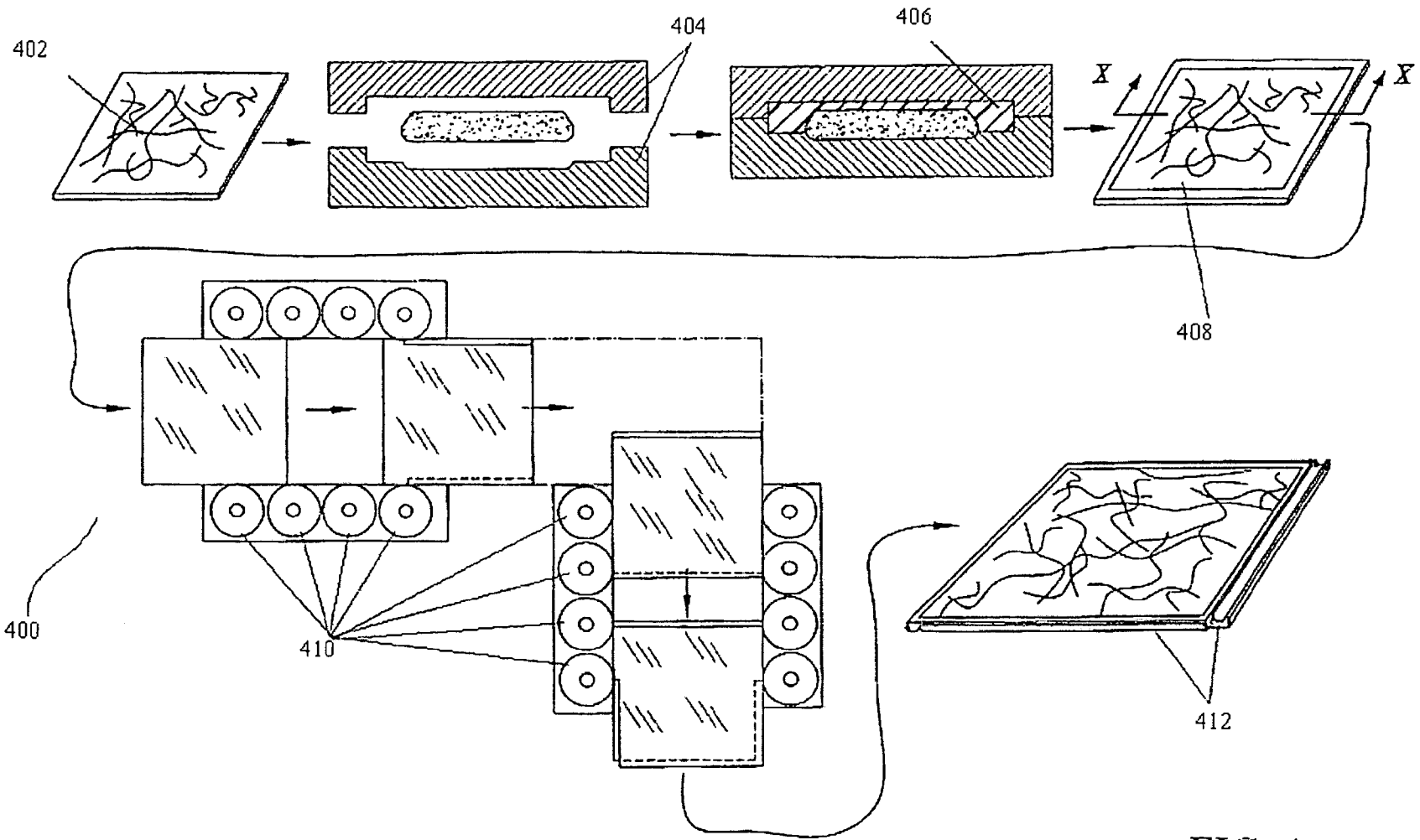
FIG. 4 is an illustration of a method for making a tile in accordance with an exemplary embodiment of the present invention.

Turning now to FIG. 4, an illustration of a method for making a tile in accordance with an exemplary embodiment of the present invention is generally depicted as 400. During the first step in the method 400, a durable surface 402 is provided and inserted into a mold 404. Once the durable surface 402 has been positioned in the mold 404 a substrate 406 may be formed around a portion of the durable surface 402. In one embodiment, the substrate 406 may be a plastic material that is injection molded or reaction injection molded (RIM) around the durable surface 402. The substrate 406 forms around the durable surface 402 to create the groutless tile 408. Next the groutless tile 408 is processed through a series of tools 410 that are used to create one or more flanges 412 around the edges of the tile 408. In one embodiment, the tools 410 may perform a milling process with one or more milling cutters that are positioned at different positions and angles with respect to the groutless tile 408. As shown in FIG. 4, the flanges 412 including the first and second coupling members may extend the entire length of one side of the substrate 406 thereby simplifying the milling process.

While the exemplary embodiments of the invention have been described, it will be understood that those skilled in the art, both now and in the future, may make various improvements and enhancements, which fall within the scope of the claims that follow. These claims should be construed to maintain the proper protection for the invention first described.

What is claimed is:

1. A groutless tile comprising:

a substrate;

a durable surface disposed within a groove defined by the substrate, the durable surface having a bottom surface and comprising a material different than the substrate;

a first coupling member disposed on an edge of the substrate, wherein the first coupling member comprises a first bendable portion and a groove, the groove of the first coupling member having an upper surface and a lower surface; and a second coupling member disposed on another edge of the substrate, wherein the second coupling member comprises a tongue and body portion, wherein the bottom surface of the durable surface is substantially coplanar with a mid-point between the upper and lower surfaces of the groove of the first coupling member;

wherein the first coupling member and the second coupling member of the substrate extend beyond the durable surface, wherein the tongue is located at a distal end of the second coupling member and extends outwardly and substantially horizontally from the other edge of the substrate, wherein the first coupling member or the second coupling member of the groutless tile are operable for coupling the groutless tile to an adjacent groutless tile, wherein the groove of the first coupling member of the groutless tile is configured to receive a body portion and a tongue of a second coupling member of the adjacent groutless tile, wherein, upon coupling the groutless tile with the adjacent groutless tile, the groove of the first coupling member of the groutless tile and the tongue of the second coupling member of the adjacent groutless tile engage under a portion of the substrate of the groutless tile where the first coupling member extends beyond the durable surface of the groutless tile, wherein, upon coupling the groutless tile with the adjacent groutless tile, a gap remains between a distal end of the tongue of the second coupling member of the adjacent groutless tile and a proximal end of the groove of the first coupling member of the groutless tile, and wherein, upon coupling the groutless tile with the adjacent groutless tile, a contact surface between the groove of the first coupling member of the groutless tile and the tongue of the second coupling member of the adjacent groutless tile is formed at a top side of the tongue, such that the contact surface limits vertical motion of the coupled groutless tiles.

2. The groutless tile of claim 1, wherein the first coupling member, the durable surface, and the second coupling member of the groutless tile form a continuous surface.

3. The groutless tile of claim 1, wherein at least a portion of the substrate is designed to have a texture and color similar to that of grout.

4. A groutless tile system comprising:

a plurality of groutless tiles, wherein each groutless tile comprises:

a substrate;

a durable surface disposed within a groove defined by the substrate, the durable surface having a bottom surface and comprising a material different than the substrate; and a first coupling member disposed on an edge of the substrate, wherein the first coupling member comprises a first bendable portion and a groove, the groove of the first coupling member having an upper surface and a lower surface;

wherein the bottom surface of the durable surface is substantially coplanar with a mid-point between the upper and lower surfaces of the groove of the first coupling member;

wherein at least a portion of the substrate extends beyond the durable surface, wherein the first coupling member and a second coupling member of an adjacent groutless tile comprising a tongue and a body portion are operable for coupling adjacent groutless tiles, wherein the tongue is located at a distal end of the second coupling member and extends outwardly and substantially horizontally from an edge of a substrate of the adjacent groutless tile, wherein the groove of the first coupling member is configured to receive the body portion and the tongue of the second coupling member, wherein, upon coupling the adjacent tiles, the tongue of the second coupling member and the groove of the first coupling member engage under the portion of the substrate that extends beyond the durable surface, wherein, upon coupling of the adjacent tiles, a gap remains between a distal end of the tongue and a proximal end of the groove of the first coupling member, wherein, upon coupling the adjacent tiles, a contact surface between the tongue of the second coupling member and the groove of the first coupling member is formed at a top side of the tongue, such that the contact surface limits vertical motion of the coupled adjacent tiles, and wherein at least a portion of the first bendable portion is disposed below the durable surface of the adjacent tile when coupled to the adjacent tile.

5. The groutless tile system of claim 4, wherein the first coupling member, the durable surface, and the second coupling member of the groutless tile form a continuous surface.

6. The groutless tile system of claim 4, wherein at least a portion of the substrate is designed to have a texture and color similar to that of grout.

7. The groutless tile system of claim 4, wherein the durable surface is partially encapsulated in the substrate thru a RIM process.

8. The groutless tile system of claim 4, wherein the plurality of groutless tiles further comprise a layment layer disposed on a surface of the substrate opposite of the durable surface.

9. The groutless tile system of claim 4, wherein a lateral force is used to couple the first coupling member and the second coupling member of an adjacent tile.

10. A groutless tile system comprising:

a plurality of groutless tiles, wherein each groutless tile comprises:

a substrate;

a durable surface disposed within a groove defined by the substrate, the durable surface having a bottom surface and comprising a material different than the substrate;

a first coupling member disposed on at least one edge of the substrate, the first coupling member comprising a first bendable portion and a groove, the groove of the first coupling member having an upper surface and a lower surface; and a second coupling member disposed on at least one edge of the substrate, the second coupling member comprising a tongue and a body portion, wherein the bottom surface of the durable surface is substantially coplanar with a mid-point between the upper and lower surfaces of the groove of the first coupling member;

wherein at least a portion of the substrate extends beyond the durable surface, wherein the tongue of the second coupling member is located at a distal end of the second coupling member and extends outwardly and substantially horizontally from the at least one edge of the substrate, wherein the first coupling member and the second coupling member of an adjacent groutless tile are operable for coupling adjacent groutless tiles, wherein the groove of the first coupling member is configured to receive the body portion and the tongue of the second coupling member of the adjacent groutless tile, wherein, upon coupling of the adjacent groutless tiles, a contact surface between the tongue of the second coupling member of the adjacent groutless tile and the groove of the first coupling member is formed at a top side of the tongue of the second coupling member of the adjacent groutless tile, wherein, upon coupling of the adjacent groutless tiles, a gap remains between a distal end of the tongue of the second coupling member of the adjacent groutless tile and a proximal end of the groove of the first coupling member, wherein, upon coupling of the adjacent groutless tiles, the groove of the first coupling member and the tongue of the second coupling member of the adjacent groutless tile engage under the portion of the substrate that extends beyond the durable surface, and wherein at least a portion of the first bendable portion of the first coupling member is disposed below the durable surface of the adjacent tile when coupled to the adjacent tile.

11. The groutless tile system of claim 10, wherein the first coupling member and the second coupling member couple adjacent groutless tiles and prevent both horizontal and vertical movement of the groutless tiles.

12. The groutless tile system of claim 10, wherein the first coupling member and the second coupling member extend an entire length of the edge of the substrate.

* * * * *